US005753099A

United States Patent [19]

Gravel et al.

[11] Patent Number: 5,753,099

[45] Date of Patent: May 19, 1998

[54] METAL RECOVERY

[75] Inventors: Bernard Gravel; Gordon Bathurst, both of Pointe Claire; John LaRiviere, Beaconsfield, all of Canada

[73] Assignee: Metafix Inc., Montreal, Canada

[21] Appl. No.: 626,941

[22] Filed: Apr. 3, 1996

[51] Int. Cl.[6] ..... C25C 7/00

[52] U.S. Cl. ..... 205/565; 205/566; 205/571; 205/702; 205/760; 205/771; 204/271; 204/272; 204/275; 204/290 R

[58] Field of Search ..... 204/271, 272, 204/275, 290 R; 205/565, 566, 571, 702, 760, 771, 263

[56] References Cited

U.S. PATENT DOCUMENTS 3,985,634 10/1976 Larson et al. ..... 204/272
4,319,971 3/1982 Good et al. ..... 205/571
4,435,252 3/1984 Kadija ..... 204/290 R
4,440,616 4/1984 Houseman ..... 204/272
4,834,849 5/1989 Woog ..... 204/105 R

*Primary Examiner*—Arun S. Phasge
*Attorney, Agent, or Firm*—Swabey Ogilvy Renault

[57] ABSTRACT

In the recovery of an electrically conductive metal from a liquid containing the metal in solution, a cathode member for deposition of the metal by electrolysis, comprises a carrier sheet with a cathode element of the metal to be recovered, on one side of the sheet; the carrier sheet is of a material from which the metal is readily refinable when smelted with the carrier sheet; the cathode member has particular application for removal of the silver content of fixer solution in photography; suitably the sheet is flexible and has a memory of a planar state, such that on being rolled into a cylindrical tubular configuration, it returns to the planar state unless restrained.

15 Claims, 3 Drawing Sheets

METAL RECOVERY

BACKGROUND OF THE INVENTION i) Field of the Invention

This invention relates to a method and apparatus for recovering a metal from solution in a liquid, and to an electrode member for use in such method and apparatus; in particular the invention is concerned with such a method, apparatus and electrode member for recovery of silver from fixer solutions employed in chemical photographic development procedures.

ii) Brief Description of Prior Art

Photography exploits the photochemical property of silver halides to form images when exposed to light. In image formation the silver halide is converted to silver in relation to the radiation received from the image. Development of a negative image produced by such exposure involves reducing the residual silver halide to silver to provide a positive image. Underdeveloped silver halide is then removed by fixation employing fixer solutions which convert the silver halide to water soluble complexes of silver.

The fixer solution thus has an increasing concentration of silver ions, while becoming depleted in the complexing chemical.

Silver is an expensive metal and additionally environmental controls do not permit disposal of used fixer solution containing silver, into the natural or municipal water systems.

Different procedures are employed for recovery of the silver in the used fixer solution, but these procedures are frequently costly and require complex equipment.

U.S. Pat. No. 4,834,849 G. Woog, describes an improved apparatus and method for electrolytic recovery of silver, which employs a disposable container as the electrolytic cell. The cathode of the cell is formed as a coating of silver integral with the interior wall of the container. During the electrolysis silver is deposited from the used fixer solution onto the silver cathode coating. Fixer solution treated in this way to remove silver can be returned to the photographic development stage, since it still contains valuable fixer chemicals, although the chemical content needs replenishing periodically.

Periodically, the disposable container with its enriched coating of deposited silver is introduced into a smelting furnace for recovery of the silver. It is a requirement of the prior patent that the container be of a material from which the silver can be easily refined. Specifically the container is of organic material, for example, a plastic which will be completely destroyed and converted to simple gaseous substances such as carbon dioxide, nitrogen and water vapour, during the high temperature smelting.

The prior patent requires that the interior surface of the container itself be coated with, and provide a substrate for, the silver cathode; additionally since the container must be fairly sturdy it has a significant mass relative to the silver coating, all of which mass is to be destroyed and converted to simple gaseous substances in the smelting furnace, thereby exploiting a significant part of the heat energy of the furnace.

SUMMARY OF THE INVENTION

It is an object of this invention to further improve on the methods and apparatus for recovering metals from solution, especially silver from used fixer solutions employed in photography.

It is a further object of the invention to provide a disposable cathode member from which silver deposited from used fixer solution can be readily recovered.

In accordance with one aspect of the invention there is provided an apparatus for electrolytic recovery of an electrically conductive metal from a liquid containing the metal in solution comprising: a) a housing defining a cavity for receiving the liquid; b) an anode removably supported within the cavity; c) a discrete cathode member comprising a carrier sheet of a material from which said metal is readily refinable when smelted with the material, said sheet having opposed first and second sides and being removably housed within said cavity with said first side adjacent an interior wall of the cavity and a second side in opposed, spaced apart facing relationship with said anode, a cathode element on said second side, said cathode element being of the same metal as the metal to be recovered; d) electrical connection means adapted to electrically connect the anode and the cathode element to a source of electricity for carrying out electrolysis within the cavity; e) an inlet for feeding the liquid containing the metal into the cavity; and f) an outlet for removal of liquid depleted in the metal, from the cavity.

In accordance with another aspect of the invention there is provided a method for recovery of an electrically conductive metal from a liquid containing the metal in solution comprising: i) providing a housing defining a cavity for receiving the liquid, an anode removably supported within said cavity, and a discrete cathode member removably housed in said cavity, said cathode member comprising a carrier sheet of a material from which said metal is readily refinable when smelted with the material, said sheet having opposed first and second sides, said first side being adjacent an interior wall of the cavity and said second side being in opposed, spaced apart relationship with said anode, a cathode element on said second side, said cathode element being of the same metal as the metal to be recovered; ii) introducing the liquid into the cavity, and iii) electrolyzing the liquid to deposit said metal from solution onto the cathode element on said second side of the cathode member.

In accordance with still another aspect of the invention there is provided a cathode member for receiving an electrolytically deposited metal in an electrolytic recovery of the metal from solution, comprising: a carrier sheet having opposed first and second sides, a cathode element on said second side, said cathode element being of the metal to be electrolytically deposited, said carrier sheet being of a material from which the metal is readily refinable when smelted with said carrier sheet.

DETAILED DESCRIPTION OF THE INVENTION

The invention is applicable to the recovery of any electrically conductive metal in solution, but has particular value in the recovery of silver from used photographic fixer solutions, and thus is particularly described here by reference to recovery of silver from used photographic fixer solutions. Persons in the art will have no difficulty in applying the procedures and teachings herein to the recovery of other metals from solutions and the following description of the preferred embodiments of the invention is not intended to restrict the scope of the invention.

a) Electrolytic Cell

The housing of the cell is not restricted in its nature, in the manner of the container in the aforementioned U.S. Pat. No. 4,834,849. A container of any convenient structural material may be employed, even metal, however, since the container should be electrically insulated from the electrodes, it is especially convenient to employ a plastic container of synthetic polymeric material. Such materials are widely available, and are not only electrically insulating, but relatively inexpensive, while being capable of providing sturdy, lightweight structures, convenient for shipping and handling.

The housing or container will conveniently include a closure, which closure is likewise suitably of a plastic material and may conveniently include an inlet port and flow passage for feeding fixer solution into the cell; and an outlet port for removal of fixer solutions depleted in silver from the cell and recycling to a photographic development for further use or delivery to a treatment unit for discardal.

In particular, the cell is portable in nature and fixer solution containing silver may be continuously or continually pumped from a fixing stage of a photographic development stage to the electrolytic cell, where the silver is deposited from the solution, the solution depleted in silver being continuously or continually returned to the fixing stage of the photographic development.

The cell is thus employed at the site of the photographic development, and the life of the fixing chemicals is extended.

The anode member is conveniently situated centrally of the cell cavity, and typically is mounted to the closure member. In one embodiment of the invention the anode is a hollow tube which communicates with the inlet port, and provides the flow passage, or part of such passage, for introducing the fixer solution into the cell; such an anode may have a single outlet at its lower end, whereby the solution is introduced into the bottom of the cell cavity; or may have a plurality of outlets, along its length, whereby the fixer solution may be introduced into the cell cavity at several different points, providing a more uniform introduction and distribution of the dissolved silver throughout the cell cavity, thereby increasing the efficiency of the electrolytic decomposition of the silver onto the cathode. Suitably the cell cavity has a generally cylindrical smooth inner cavity wall spaced from the anode, the cavity wall being adapted for contact with the removable cathode member.

b) Cathode Member

The cathode member is a distinct, discrete component separate from the container of the electrolytic cell, unlike the cathode in the aforementioned U.S. Pat. No. 4,834,849.

The discrete cathode member is an integral structure comprising a carrier sheet with a cathode element on one side; the cathode element is conveniently of silver for deposition of silver from solution.

The carrier sheet is of a material from which the silver is readily refinable when smelted with the material.

Most suitably the carrier sheet is organic, for example, a plastic sheet of an electrically insulating synthetic polymer which is thermally destroyed during the smelting of the silver. By way of example the plastic sheet may be high density polyethylene or a polyester sheet such as that available under the Trade Mark MYLAR of E. I. duPont de Nemours Co., or a polyester sheet such as that available under the Trade Mark MELINEX of I.C.I. America Inc.

Furthermore, the carrier sheet is flexible and rollable into a cylindrical tubular configuration readily received within the cell cavity with the outer surface of the tubular configuration in opposed relationship with the, preferably cylindrical, smooth inner cavity wall.

The sheet retains, however, a memory of its planar configuration.

The carrier sheet has a length or height substantially the same but not greater than the height of the smooth inner cavity wall, and a width not less than, and preferably greater than the circumference of the inner cavity wall.

A cathode element is formed on the side of the carrier sheet which is to form the inside surface of the tubular configuration.

In operation the sheet is rolled into the tubular configuration with the cathode element on the inside surface of the tubular configuration. The sheet is rolled to a tubular configuration having a diameter less than that of the inner cavity wall, whereby the rolled sheet is readily inserted in the cavity. Within the cavity the tubular configuration expands in diameter as the sheet attempts to unroll to its planar configuration; the expansion occurs until the outer surface of the tubular configuration engages the inner cavity wall, with the tubular configuration having substantially the same diameter as the inner cavity wall.

Conveniently the sheet has a plurality of spaced apart orifices at a location which will permit exposure to the interior of the tubular configuration, of an electrical contact plate on the inner cavity wall.

The cathode element is suitably a pattern of electrically interconnected metal zones formed on the surface of the carrier sheet which is to form the inside surface of the tubular configuration. The metal zones may, for example, be formed as lines forming a grid-like pattern over the sheet surface.

The pattern may be formed by any convenient technique, for example, by printing.

Suitable printing inks include the silver inks available from DuPont Electronics which have a viscosity of 20 to 30 Pa-s (Brookfield RVT, 5 rpm, #14 spindle and UC 25° C.); a solids content of 68 to 72%, by wt., the ink vehicle comprising organic solvent. These inks can be employed with manual, semi-automatic and reel-to-reel equipment.

As indicated, the carrier sheet is suitably flexible and in its normal configuration is substantially flat or planar, and has a memory of the planar state such that when it is distorted by light pressure from such state, as when it is shifted into a curved configuration or rolled, on release of the pressure it will return, unless; restrained, to the planar state.

The metal zones of the pattern are separated by non-metal zones defined by the carrier sheet itself.

The area of the metal zones in the patterned area of the sheet may suitably be from 8% to 100%, preferably about 10%, of the total patterned area.

The pattern of the grid is purposely square in shape so that the sharp corners in the grid pattern will improve the plating ability of the cathode element.

It is not necessary that the cathode element cover 100% of the area as a continuous film, and in this way a saving in the amount of metal required to form the cathode element, is achieved.

In order to facilitate the electrical contact the sheet may suitably have a contact zone of the metal, for example, a printed band of the metal extending the width of the sheet on the other side of the sheet opposite the side with the cathode element. This contact zone is formed in the region of the orifices, so as to engage the electrical contact plate on the inner cavity wall. The electrical coupling between the contact plate and the printed band thus provides efficient conduction of current around the circumference of the tubular configuration.

In order to further facilitate electrical coupling between the contact plate and the cathode element a connecting zone of the metal may be formed about each of the orifices on the side of the sheet bearing the cathode element.

In forming the contact zone and the opposed connecting zones, suitably by printing, metal also extends into the circumferential wall of each orifice producing electrical connection between the contact zone and the connecting zones.

The carrier sheet suitably has a thickness of 0.003 in. to 0.007 in., preferably about 0.005 in.; and the cathode element, the contact zone and the connecting zones suitably have a thickness of 0.0007 in. to 0.0013 in., preferably about 0.001 in.

c) Method

In operation a cathode member of the invention is rolled from its planar configuration to a tubular configuration of smaller diameter than the diameter of the cell cavity, and with the cathode element on the inside surface of the tubular configuration. The tubular configuration, under restraint, is inserted into the cell cavity and the restraint is released, whereupon the tubular configuration expands or flexes as the carrier sheet attempts to unroll, until the carrier sheet engages the interior wall of the cavity.

The cavity is closed and the inlet port is connected to the fixer tank of a photographic development station and fixer solution containing dissolved silver ions is pumped from the fixer tank into the cell cavity to fill the cavity between the cathode member and the anode.

The outlet port is connected to the fixer tank for return of fixer solution, from which dissolved silver ions have been removed, to the fixer tank.

A source of direct electrical current is connected between the anode and cathode member, and current allowed to flow, whereupon silver ions in solution in the cavity, migrate to the cathode element and silver is deposited on the silver metal pattern of the cathode element. The silver is deposited on the surface of the silver zones, but also on the edges so that the area of the metal zones increases and the area of the non-metal zones decreases.

Initially, the electrical coupling between the metal zones of the cathode element and the contact plate of the cavity wall, via one or more of the orifices through the sheet, may be poor.

In such case the silver ions will be discharged on the portion of the contact plate exposed by the orifice or orifices and silver deposits will build on the exposed portions of the contact plate. As the silver deposit builds up on this exposed portion of the contact plate it will provide or improve the electrical coupling with the cathode element, so that further deposition of silver occurs on the metal zones across the sheet.

The fixer solution (containing dissolved silver ions is suitably pumped into the cell cavity. In the case of a cell cavity having a volume of about 1 to about 2 liters and preferably 1.4 liters the fixer solution free of dissolved silver ions is suitably pumped from the cavity at a flow rate of 18 to 45 l/min., preferably about 30 l/min., to provide a residence time of the solution in the cell cavity of about 1 sec. to about 10 sec., preferably about 1.3 to 6.6 sec. This high rate of flow produces significant turbulence in the fixer solution in the cavity and ensures efficient contact between the solution and the cathode element, while allowing an adequate residence time for efficient removal of the silver ions from solution.

The fixer solution depleted in silver ions, which is returned to the fixer tank may need to be replenished with fixing chemicals periodically.

Periodically the flow of fixer solution to and from the cell cavity is interrupted, and the cathode member with its deposit of silver is removed. The cathode member is delivered to a silver smelting furnace in which the silver is recovered and the carrier sheet is thermally decomposed.

A fresh cathode member is inserted in the cell cavity as described hereinbefore, for resumption of the recovery process.

Typically a cathode member having a silver cathode element in an amount by weight of about 0.7 g, can operate to receive a weight of deposited silver of about 5 kg.

DESCRIPTION OF PREFERRED EMBODIMENTS WITH REFERENCE TO THE DRAWINGS

Figure 1:
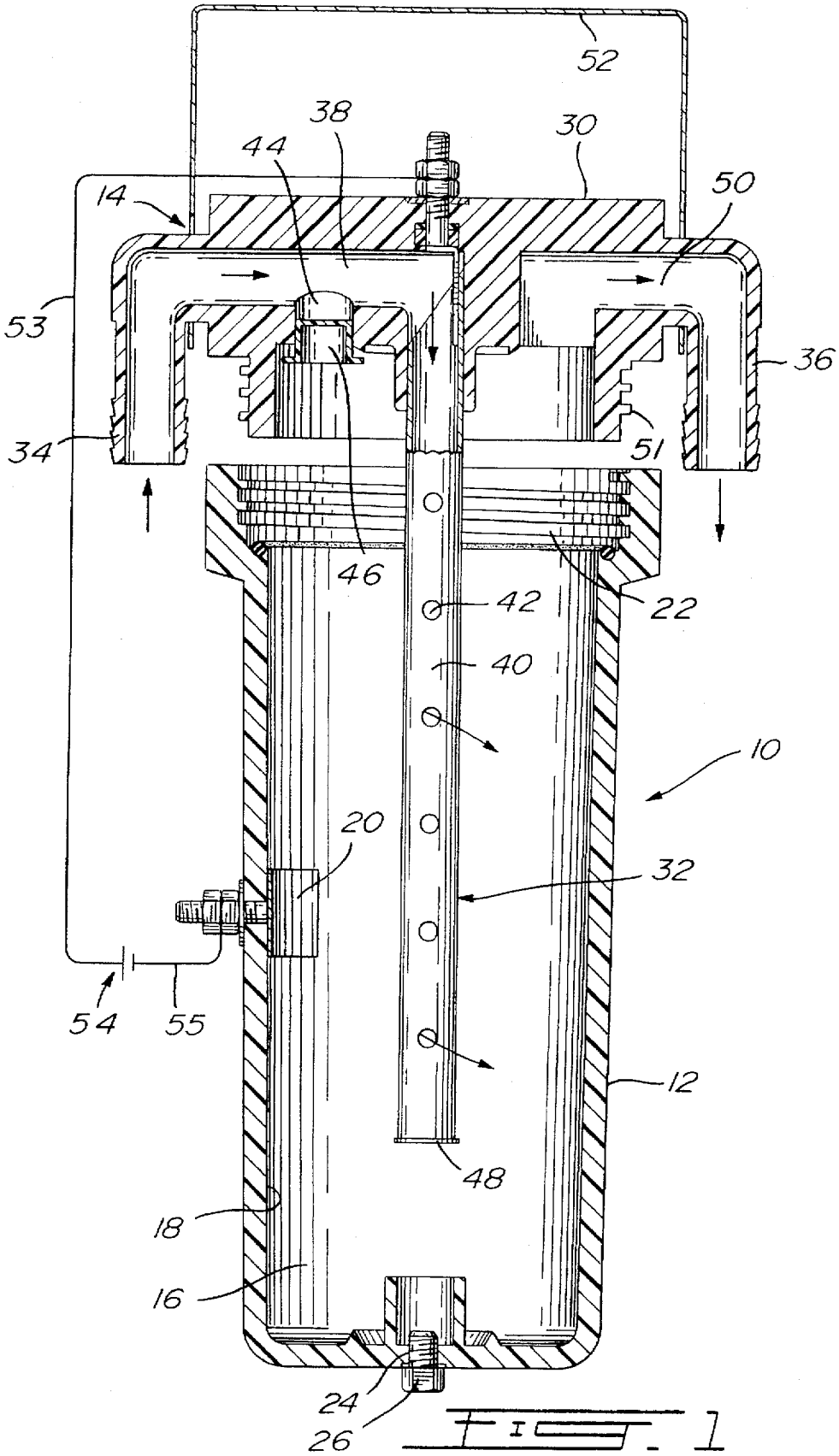
FIG. 1 is a schematic cross section of an electrolytic cell of the invention, in an exploded configuration with the closure raised and the cathode member omitted.

With further reference to FIG. 1, an electrolytic cell 10 has a cell housing 12 and a cell closure 14.

Cell housing 12 has a cell cavity 16 defined by a cavity wall 18. A contact plate 20 is supported on cavity wall 18, extending arcuately of the wall intermediate upper and lower ends. Cell housing 12 includes a threaded zone 22 at an upper end and a bottom outlet 24 having a plug 26.

Cell closure 14 includes a head 30 from which extends a tubular anode 32. Head 30 includes an inlet port 34 and an outlet port 36.

An inlet flow passage 38 extends internally of head 30 between inlet port 34 and an anode passage 40 through tubular anode 32. An inflow port 44 forms a branch from inlet flow passage 38 and as shown in FIG. 1 inflow port 44 is closed by a plug 46.

Tubular anode 32 is closed by a plug 48.

An outflow passage 50 in head 30 communicates with outlet port 36.

Cell closure 14 includes a handle member 52.

A source 54 of electric current is connected via lead 53 to anode 32 and by lead 55 to contact plate 20.

Figure 2:
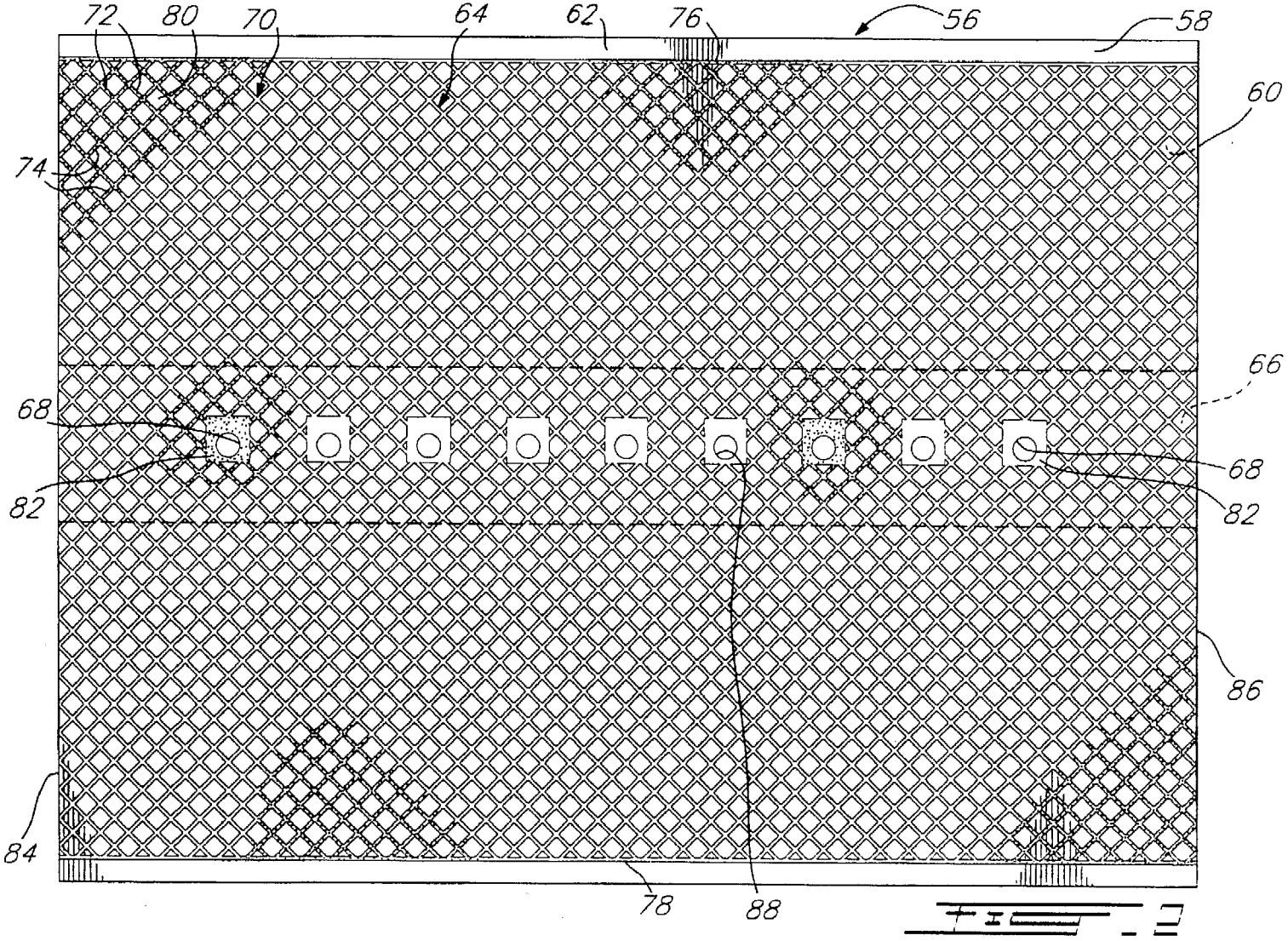
FIG. 2 is a front view of a cathode member of the invention.

With further reference to FIG. 2, a cathode member 56 comprises a transparent carrier sheet 58 having a first side 60 and a second side 62, and a cathode element 64 on second side 62.

Contact zone 66 formed as a wide band is supported on side 60 and a plurality of orifices 68 extend through sheet 58, and through contact zone 66.

Cathode element 64 is defined by silver zones 70 which comprise a plurality of diagonal printed silver lines 72 and a plurality of diagonal printed silver lines 74 generally perpendicular to the lines 72; an upper horizontal printed silver line 76 and a lower horizontal printed silver line 78. The lines 70 and 72 extend between upper and lower lines 76 and 78 or extend from one of these lines 76 and 78 to a side edge 84 or 86 of sheet 58.

Non-metal zones 80 are defined between the lines 72 and 74 and between the lines 72, 74 and 76; and 72, 74 and 78; as well as between lines 72 and 74 and the side edges 84 and 86 respectively.

Connecting zones 82 of silver are printed about orifices 68 on side 62.

The silver of connecting zones 82 and contact zone 66 should extend on to the thin wall 88 of each orifice 68 to provide electrical connection between the cathode element 64 on second side 62 of sheet 58 and the contact zone 66 on first side 60 of sheet 58.

The carrier sheet 58, is a self-supporting sheet which has a memory which urges it into a planar configuration as its normal, stable configuration.

Figure 3:
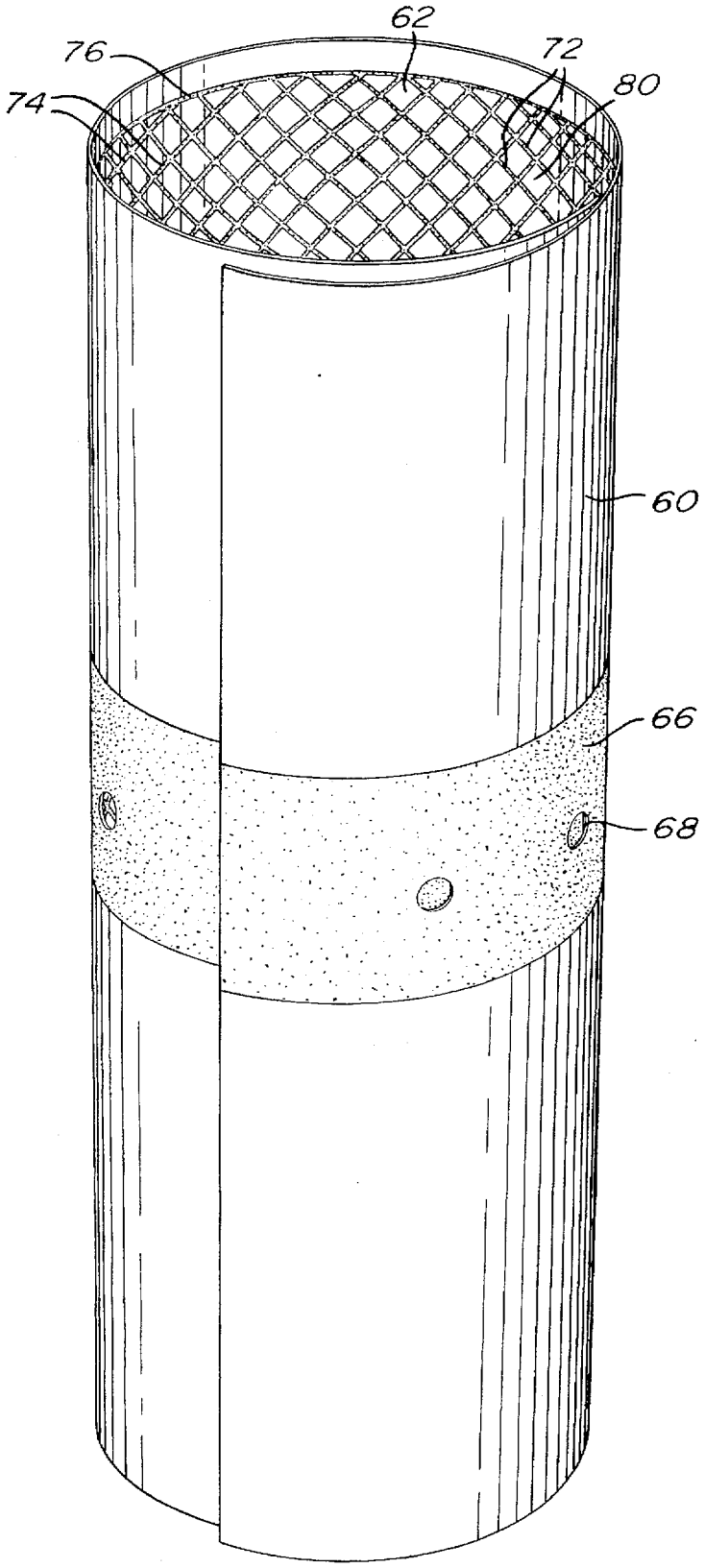
FIG. 3 shows the cathode member of FIG. 2 rolled to a tubular configuration.

In order to insert cathode member 56 in cavity 16 of cell 10, the sheet 58 is first rolled to a tubular configuration illustrated generally in FIG. 3, with second side 62 forming the inwardly facing surface and first side 60 forming the outwardly facing surface. Sheet 58 is rolled to a tubular configuration having a diameter lass than the diameter of cell cavity 16. This configuration is illustrated generally in FIG. 3.

The tubular configuration of FIG. 3 is held under restraint, since if the restraining forces are removed, it will revert to the planar configuration of FIG. 2. In the tubular configuration, the cathode member 56 is inserted into the open cell housing 12, and is received in cell cavity 16. On release of the restraining forces, the sheet 58 flexes and attempts to unroll to its planar configuration and this causes expansion of the tubular configuration until first side 60 of the sheet 58 in the tubular configuration engages and is restrained by cavity wall 18. The first side 60 of the sheet is then essentially in adjacent relationship with cavity wall 18, with the outermost portion of side 60, in the tubular configuration, engaging cavity wall 18. A portion of first side 60 will overlap and engage a portion of second side 62, to the extent that the width of sheet 58 (the width being the greater dimension seen in FIG. 2) is greater than the circumferential length of cavity wall 18.

With the cathode member 56 in place, cell closure 14 is threaded by threaded portion 51 to the threaded zone 22 of cell housing 12 to close cell 10 with anode 32 disposed generally centrally within cavity 16 and spaced apart from cathode element 64.

It will be understood that the band forming contact zone 62 on first side 60 of sheet 58 is located and generally of a width to ensure that it will engage contact plate 20 on cavity wall 18.

With the closure 14 in place, inlet port 34 is connected to a conduit communicating with a fixer tank (not shown) for delivery to cell 10 of fixer solution containing dissolved silver ions, and outlet port 36 is connected for return of fixer solution free of silver ions to the fixing tank.

It will be recognized that after a period of electrolysis all that is necessary is to interrupt the flow of solution to cell 10, and preferably to exhaust the liquid content of cell 10, whereafter the cell closure 14 is readily removed by unthreading from housing 12, the cathode member 56 with its deposit of silver is removed and a new cathode member 56 is installed so that the recovery of silver from the fixer solution may continue.

The cathode member 56 with its deposit of silver is put aside and at suitable intervals a number of such cathode members 56 with their deposits of silver are dispatched to a silver smelting furnace where the silver is smelted and the carrier sheet 58 thermally decomposed to gaseous elements, whereby the valuable silver is recovered.

As indicated, fixer solution depleted in dissolved silver is removed through outlet port 36 and recycled to the fixer tank since it still contains valuable fixer chemicals. Of course, with the passage of time the fixer solution revolving between the fixer tank and the cell 10 becomes depleted in fixer chemicals and ultimately may be discarded, however, at this point the silver concentration has been greatly reduced and most of the silver has been recovered.

It can be seen that the cell 10 can be employed repeatedly with fresh cathode members 56, and is thus not subject to disposal at the rate required by the procedure in the aforementioned U.S. Pat. No. 4,834,849.

Sediment and other residues which accumulate at the bottom of cavity 16 as electrolysis proceeds may be removed periodically through bottom outlet 24 on removal of plug 26. This step) may conveniently be carried out at a stage in which the cavity 16 has been exhausted of fixer solution for replacement of the cathode member 56. Such sediments and residuals can conveniently be flushed from cavity 16 through outlet 24 with water.

The cell 10, as illustrated includes a tubular anode 32 with a plurality of orifices 42 providing delivery of fixer solution to different levels of cavity 16. It is within the scope of the invention to employ a tubular anode 32 which does not include the anode orifices 44 and in such case the fixer solution would enter the cavity 16 at the lower end thereof via the outlet which, in FIG. 1, is closed by plug 48. Similarly it is within the scope of the invention to employ a solid anode 32 in which case plug 46 in inflow port 44 is removed to permit flow of the fixer solution from inlet flow passage 38 through inflow port 44 into cavity 16.

We claim:

1. An apparatus for electrolytic recovery of an electrically conductive metal from a liquid containing the metal in solution comprising:

a) a housing defining a cavity for receiving the liquid;

b) an anode removably supported within the cavity;

c) a discrete cathode member comprising a carrier sheet of a material from which said metal is readily refinable when smelted with the material.

said sheet having opposed first and second sides and being removably housed within said cavity with said first side adjacent an interior wall of the cavity and a second side in opposed, spaced apart facing relationship with said anode, said carrier sheet being a flexible sheet of electrically insulating material said sheet being rollable into a cylindrically tubular configuration, said flexible sheet having a memory of a planar state, such that on being rolled into said tubular configuration, it returns to the planar configuration unless restrained, a cathode element on said second side, said cathode element being of the same metal as the metal to be recovered;

d) said cathode element comprising a pattern of metal zones said metal zones being separated by a plurality of non-metal zones defined by the carrier sheet, said metal zones being electrically interconnected;

e) a contact zone of said metal on said first side, and at least one orifice extending through said sheet and contact zone and means at said at least one orifice providing electrical contact between the contact zone and the cathode element, f) a first electrical connection means adapted to electrically connect the anode to a source of electricity for carrying out electrolysis within the cavity, and a second electrical connection means adapted to electrically connect the cathode element to the source of electricity, said second electrical connection means comprising an electrical contact member on said interior wall for electrical contact with said contact zone;

g) an inlet for feeding the liquid containing the metal into the cavity; and h) an outlet for removal of liquid depleted in the metal, from the cavity.

2. An apparatus according to claim 1, wherein said pattern is printed on said second side of said carrier sheet; and said contact zone of the metal is printed on said first side.

3. An apparatus according to claim 2, wherein said contact zone is a printed band of the metal and including a plurality of spaced apart orifices extending through said sheet and band, and a connecting zone of the metal printed about each orifice on said second side and, each of said orifices having an orifice wall extending between said first and second sides of said sheet, each said orifice wall having the metal printed thereon to enhance electrical connection between said band and said pattern.

4. An apparatus according to claim 3, wherein said metal is silver.

5. An apparatus according to claim 3, wherein said interior wall is cylindrical, said cathode member is of tubular configuration and said electrical contact member extends arcuately of said cylindrical interior wall for electrically coupling with said printed band to provide efficient conduction of electric current around the circumference of the tubular configuration.

6. An apparatus according to claim 1, wherein said metal is silver.

7. An apparatus according to claim 1, wherein said interior wall is cylindrical and said electrical contact member extends arcuately of said interior wall; and said contact zone comprises; a printed band of the metal for electrical coupling with said contact member.

8. A method for recovery of an electrically conductive metal from a liquid containing the metal in solution comprising:

i) providing a housing defining a cavity for receiving the liquid, an anode removably supported within said cavity, and a discrete cathode member removably housed in said cavity, said cathode member comprising a carrier sheet of a material from which said metal is readily refinable when smelted with the material, said sheet having opposed first and second sides, said first side being adjacent an interior wall of the cavity and said second side being in opposed, spaced apart relationship with said anode, said carrier sheet being a flexible sheet of electrically insulating material, said sheet being rollable into a cylindrically tubular configuration, said flexible sheet having a memory of a planar state such that on being rolled into said tubular configuration, it returns to the planar configuration unless restrained, a cathode element on said second side, said cathode element being of the same metal as the metal to be recovered; said cathode element comprising a pattern of metal zones, said metal zones being separated by a plurality of non-metal zones defined by the carrier sheet, said metal zones being electrically interconnected;

a contact zone of said metal on said first side, and at least one orifice extending through said sheet and contact zone and means at said at least one orifice providing electrical contact between the contact zone and the cathode element, ii) introducing the liquid into the cavity; and iii) electrolyzing the liquid to deposit said metal from solution onto the cathode element on said second side of the cathode member.

9. A method according to claim 8, including a step of iv) recovering said cathode member having a deposit of said metal, from said cavity, and smelting the recovered cathode member.

10. A method according to claim 9, wherein said metal is silver and said liquid is derived from a photographic fixer solution.

11. A method according to claim 8, wherein said liquid is maintained under turbulent conditions in said cavity in step iii).

12. A method according to claim 11, wherein said cavity is of a volume and said liquid is introduced into said cavity at a flow rate such that the liquid has a residence time in said cavity of 1 to 10 seconds.

13. A cathode member for receiving an electrolytically deposited metal in an electrolytic recovery of the metal from solution, comprising:

a carrier sheet having opposed first and second sides, a cathode element on said second side, said cathode element being of the metal to be electrolytically deposited, said carrier sheet being of a material from which the metal is readily refinable when smelted with said carrier sheet, said carrier sheet being a flexible sheet of electrically insulating material, said sheet being rollable into a cylindrically tubular configuration, said flexible sheet having a memory of a planar state, such that on being rolled into said tubular configuration, it returns to the planar configuration unless restrained, said cathode element comprising a pattern of metal zones, said metal zones being separated by a plurality of non-metal zones defined by the carrier sheet, said metal zones being electrically inter-connected;

a contact zone of said metal on said first side, and at least one orifice extending through said sheet and contact zone and means at said at least one orifice providing electrical contact between the contact zone and the cathode element.

14. A cathode member according to claim 13, wherein said pattern is printed on said second side and said contact zone is a printed band of the metal and including a plurality of spaced apart orifices extending through said sheet and band, and a contacting zone of the metal printed about each orifice on said second side and each of said orifices having an orifice wall extending between said First and second sides of said sheet, each said orifice wall having the metal printed thereon.

15. A cathode member according to claim 14, wherein said metal is silver.

* * * * *